US009283796B2

(12) United States Patent
Mutsuno

(10) Patent No.: US 9,283,796 B2
(45) Date of Patent: Mar. 15, 2016

(54) SHEET PROCESSING APPARATUS, CONTROL METHOD OF SHEET PROCESSING APPARATUS, AND STORAGE MEDIUM

(71) Applicant: CANON KABUSHIKI KAISHA, Tokyo (JP)

(72) Inventor: Masahiro Mutsuno, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 278 days.

(21) Appl. No.: 13/926,520

(22) Filed: Jun. 25, 2013

(65) Prior Publication Data

US 2014/0003885 A1 Jan. 2, 2014

(30) Foreign Application Priority Data

Jun. 27, 2012 (JP) ..... 2012-143740

(51) Int. Cl.

| | |
|---|---|
| ***B42B 4/00*** | (2006.01) |
| ***B31F 5/00*** | (2006.01) |
| ***B65H 33/04*** | (2006.01) |
| ***B65H 43/04*** | (2006.01) |
| ***B42C 1/12*** | (2006.01) |
| ***B65H 37/04*** | (2006.01) |
| ***B42C 1/00*** | (2006.01) |
| *G03G 15/00* | (2006.01) |

(52) U.S. Cl.

CPC . *B42B 4/00* (2013.01); *B31F 5/001* (2013.01); *B31F 5/003* (2013.01); *B42C 1/00* (2013.01); *B42C 1/12* (2013.01); *B65H 33/04* (2013.01); *B65H 37/04* (2013.01); *B65H 43/04* (2013.01); *B65H 2801/27* (2013.01); *G03G 15/50* (2013.01); *G03G 15/6541* (2013.01); *G03G 2215/00827* (2013.01); *G03G 2215/00831* (2013.01)

(58) Field of Classification Search

CPC ..... B42B 4/00; B42C 1/00; B42C 1/12; B31F 5/001; B31F 5/003; G03G 15/50; G03G 15/6541; G03G 2215/00827; G03G 2215/00831; B65H 37/04; B65H 43/04; B65H 33/04; B65H 2801/27

USPC ..... 270/37, 58.08, 58.09, 58.31; 412/6, 11; 399/410

See application file for complete search history.

(56) References Cited

U.S. PATENT DOCUMENTS

| | | | | |
|---|---|---|---|---|
| 6,339,685 | B1 * | 1/2002 | Okamoto et al. | 399/16 |
| 6,948,224 | B2 * | 9/2005 | Coombs et al. | 29/407.01 |
| 7,597,311 | B2 * | 10/2009 | Kawata et al. | 270/37 |
| 8,226,076 | B2 * | 7/2012 | Shirakuma et al. | 270/32 |
| RE43,687 | E * | 9/2012 | Ohtani | 399/82 |
| 8,755,075 | B2 * | 6/2014 | Nonaka | 358/1.15 |

FOREIGN PATENT DOCUMENTS

| | | |
|---|---|---|
| JP | 2003091390 A | 3/2003 |

* cited by examiner

*Primary Examiner* — Leslie A Nicholson, III

(74) *Attorney, Agent, or Firm* — Carter, DeLuca, Farrell & Schmidt, LLP

(57) ABSTRACT

To execute a saddle stitch bookbinding process to prints including an insert paper, there is provided a control method for controlling a sheet processing apparatus, comprising: inserting the insert sheet from a second sheet holder in a plurality of sheets from a first sheet holder, and causing a saddle stitch bookbinder to execute the saddle stitch bookbinding process to the plurality of sheets in which the insert sheet has been inserted; determining whether or not the insert sheet is a sheet of a type to which the saddle stitch bookbinding process can be executed; and, in a case where it is determined that the insert sheet is not the sheet of the type to which the saddle stitch bookbinding process can be executed, controlling the saddle stitch bookbinder not to execute the saddle stitch bookbinding process to the plurality of sheets in which the insert sheet has been inserted.

6 Claims, 6 Drawing Sheets

FIG. 8

| | COVER SHEET | BODY TEXT |
|---|---|---|
| PLAIN PAPER | ○ | ○ |
| RECYCLED PAPER | ○ | ○ |
| THICK PAPER | × | × |
| COATED PAPER | × | × |

SHEET PROCESSING APPARATUS, CONTROL METHOD OF SHEET PROCESSING APPARATUS, AND STORAGE MEDIUM

BACKGROUND OF THE INVENTION

1. Field of the Invention

The present invention relates to a sheet processing apparatus, a control method for controlling the sheet processing apparatus, and a storage medium for storing a program to achieve the control method.

2. Description of the Related Art

Conventionally, a sheet processing apparatus which inserts an insert sheet in prints has been provided. In the sheet processing apparatus like this, for example, it is possible to produce the prints on which images have been printed in monochrome respectively, and further to insert the insert sheet on which an image has been printed in color in the produced prints (Japanese Patent Application Laid-Open No. 2003-091390).

Also, a sheet processing apparatus which executes a saddle stitch bookbinding process has been provided conventionally. Here, in case of executing such a saddle stitch bookbinding function, the sheet processing apparatus like this produces the prints by printing images respectively on a plurality of sheets, binding roughly the central portions of these sheets, and folding the bound sheets in half at the bound central portions thereof.

Incidentally, the conventional sheet processing apparatus can insert the insert sheet in the prints which are laid out flat, but cannot insert the insert sheet in the prints to which the saddle stitch bookbinding process is executed. For this reason, even when a user wishes a bound book or booklet which consists of monochrome-printed prints and a color-printed insert sheet which has been inserted as a spread in the monochrome-printed prints, the user cannot acquire the book or booklet like this.

SUMMARY OF THE INVENTION

An object of the present invention is to solve such a conventional problem as described above. To solve the above problem, in the present invention, there is provided a sheet processing apparatus which comprises: an executing unit configured to insert an insert sheet fed from a second sheet holding unit in a plurality of sheets fed from a first sheet holding unit, and cause a saddle stitch bookbinding device to execute a saddle stitch bookbinding process to the plurality of sheets in which the insert sheet has been inserted; a determining unit configured to determine whether or not the insert sheet is a sheet of a type to which the saddle stitch bookbinding process can be executed; and a control unit configured to, in a case where it is determined by the determining unit that the insert sheet is not the sheet of the type to which the saddle stitch bookbinding process can be executed, control the saddle stitch bookbinding device not to execute the saddle stitch bookbinding process to the plurality of sheets in which the insert sheet has been inserted.

Further features of the present invention will become apparent from the following description of exemplary embodiments with reference to the attached drawings.

BRIEF DESCRIPTION OF THE DRAWINGS

FIG. 8 is a diagram for describing restriction conditions in a sheet process.

DESCRIPTION OF THE EMBODIMENTS

Hereinafter, preferred embodiments of the present invention will be described in detail in accordance with the accompanying drawings.

Description of System Constitution and Configuration

First Embodiment

Figure 1:
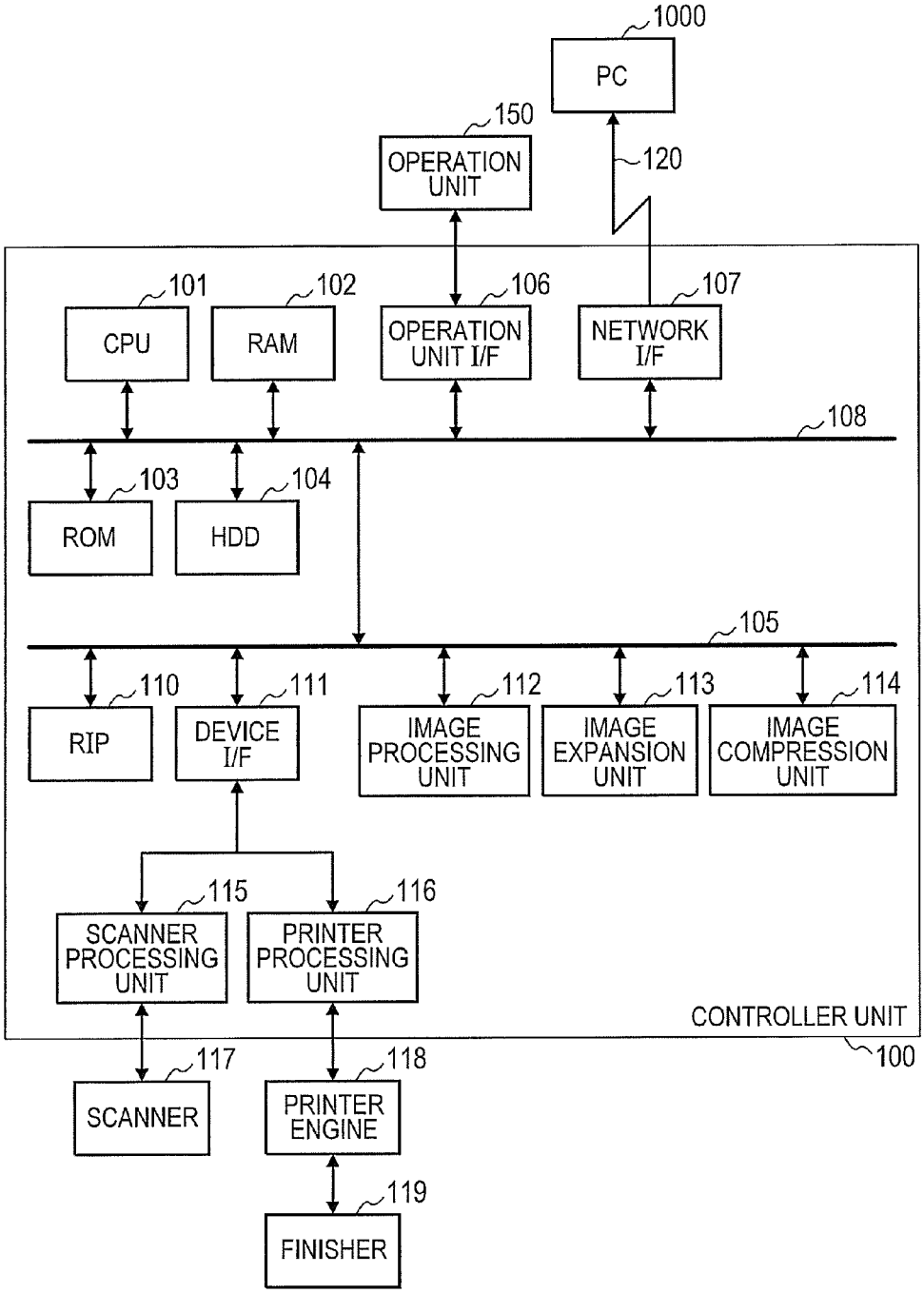
FIG. 1 is a block diagram illustrating an entire constitution and configuration of an image processing system.

FIG. 1 is a block diagram illustrating an entire constitution and configuration of an image processing system which includes an image forming apparatus and a PC (personal computer), according to the present embodiment.

In FIG. 1, a controller unit 100 controls a scanner 117 which serves as an image input device, a printer engine 118 which serves as an image output device, and a finisher 119. Moreover, the controller unit 100 is equipped with an operation unit 150 which is used to accept an input instruction from an operator and display information to the operator. A scanner processing unit 115 is connected to the scanner 117, and the printer engine 118 and the finisher 119 are connected to a printer processing unit 116. The scanner processing unit 115, the printer processing unit 116 and the operation unit 150 are respectively connected to the controller unit 100, and thus controlled in response to instructions from the controller unit 100.

Further, a CPU (central processing unit) 101 is connected to a RAM (random access memory) 102, a ROM (read only memory) 103, an HDD (hard disk drive) 104, an image path I/F (interface) 105, an operation unit I/F 106 and a network I/F 107, through a system bus 108. The CPU 101 controls the image forming apparatus as a whole. For example, the CPU controls the scanner 117 to scan and read an original document, controls the printer engine to execute printing, controls communication with a PC 1000, and controls the operation unit 150 to execute a display. The RAM 102 is a memory to be used to provide a working area for the CPU 101, and the RAM 102 is used as a setting value memory for temporarily storing parameter settings and an image memory for temporarily storing various image data. The ROM 103 is a boot ROM in which a system boot program has been stored, and the HDD 104 is a memory in which system software, a controller program, a parameter setting value history, image data and the like have been stored.

The CPU 101 can record the system boot program stored in the ROM 103 to the RAM 102, and then execute the recorded system boot program. Thus, the CPU 101 comes to be in a state capable of executing the system software and the controller program.

The operation unit 150 comprises hardware keys for accepting instructions from a user, and a display section for displaying an operation screen and a system condition screen. Moreover, the display section comprises a touch panel through which the instruction from the user is accepted by the operation unit 150. The operation unit I/F 106 is the interface to input and output various data between the controller unit and the operation unit 150. The operation unit I/F 106 outputs, to the operation unit 150, image data to be displayed on the display section of the operation unit 150 in response to the instruction from the CPU 101. Also, the operation unit I/F 106 transfers, to the CPU 101, the information input by the operator through the hardware keys or the touch panel of the operation unit 150.

The network I/F 107, which is connected to a LAN (local area network) 120, is used to input and output information from and to the LAN 120. An RIP (raster image processor) 110 is used to decompress a PDL (page description language) code received from the LAN 120 to a bitmap image.

When an image process to the image data is executed by the printer processing unit 116 and the processed image data is output by the printer engine 118, an image expansion unit 113 is used to decode and decompress the image data compressed, encoded and thus stored in the HDD 104. Further, when the image data processed by the RIP 110 or the scanner processing unit 115 is stored in the HDD 104, an image compression unit 114 is used to encode the image data in a predetermined compression manner.

A device I/F 111 is used to connect the scanner 117, the printer engine 118 and the finisher 119 to the controller unit through the scanner processing unit 115 and the printer processing unit 116 respectively, convert the image data synchronously and asynchronously, and further transfer a setting value, an adjusting value, and data of a device status.

The scanner processing unit 115 executes various processes such as correction, edit, image separation, magnification change, binarization and the like to the image data input from the scanner 117. The scanner 117, which comprises an automatic continuous document feeder and a platen reading device both not illustrated, can read images on both sides of each of a plurality of originals (original documents). Further, the scanner comprises not-illustrated sensors for sensing whether or not the platen cover is being opened, sensing whether or not the original exists, and detecting the size of the original. Here, the detected information, status information indicating the status of the scanner 117, and the like are transmitted to the CPU 101 through the scanner processing unit 115 and the device I/F 111.

The printer engine 118 feeds sheets (papers) from a sheet (paper) feeding cassette in which the sheets to be used for printing have been held, prints an image on each of the fed sheets on the basis of the image data, and discharges the sheets on which the images have been printed outside the apparatus. The printer processing unit 116 executes various processes such as correction, resolution conversion and the like to image data to be print-output in accordance with the printer engine 118, and also executes a process of adjusting a print position of the printed image. Further, the printer processing unit executes a process of controlling the finisher 119 which executes various post-processes such as a stapling process, a punching process, a saddle stitch bookbinding process and the like.

<Description of Software Module>

Figure 2:
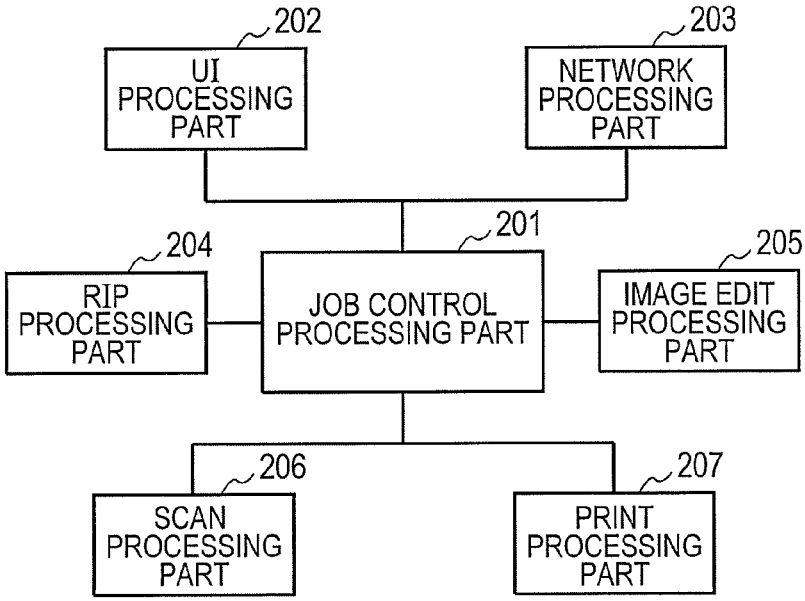
FIG. 2 is a block diagram illustrating a module configuration of a sheet processing apparatus according to an embodiment of the present invention.

FIG. 2 is a block diagram illustrating a module configuration of a sheet processing system according to the present embodiment. Here, it should be noted that a data process corresponding to each software module described later is achieved on condition that the software module is loaded to the RAM 102 and executed mainly by the CPU 101.

In FIG. 2, a job control processing part 201 is a module which controls each of illustrated/not-illustrated software modules as a whole, and further controls all jobs such as a copy job, a print job, a scanning job, a UI (user interface) process job and the like occurred in the image forming apparatus.

A UI processing part 202 is a module which mainly controls the operation unit 150 and the operation unit I/F 106. More specifically, the UI processing part notifies the job control processing part 201 of the contents of user's operation to the operation unit 150, and also controls the contents to be displayed on the display screen of the operation unit 150 in response to an instruction from the job control processing part 201. Moreover, the UI processing part executes editing of drawing data to be displayed on the operation unit 150.

A network processing part 203 is a module which mainly controls communication to be executed with external device through the network I/F 107. More specifically, the network processing part controls communication with each device on the LAN 120. When a control command or data from each device on the LAN 120 is received by the network processing part 203, this part notifies the job control processing part 201 of such a received content. Moreover, the network processing part transmits a control command or data to each device on the LAN 120 in response to an instruction from the job control processing part 201.

An RIP processing part 204 is a module which decompresses a PDL code to a bitmap image by interpreting the PDL code and executing rendering under the control of the RIP 110, in response to an instruction from the job control processing part 201.

An image edit processing part 205 is a module which executes an image process to a designated image by controlling an image processing unit 112, in response to an instruction from the job control processing part 201. The image edit processing part 205 accepts the image data or image information (image data size, color mode, resolution, etc.) from the job control processing part 201. Further, the image edit processing part executes an appropriate image process to the image data by controlling the image processing unit 112, the image expansion unit 113 and the image compression unit 114, and then notifies the job control processing part 201 of the image acquired after the image process.

A scan processing part 206 is a module which instructs to read the original set on the scanner 117 by controlling the scanner 117 and the scanner processing unit 115 in response to an instruction from the job control processing part 201.

Then, the scan processing part 206 instructs the scanner processing unit 115 to execute the image process to the read original image. Further, the scan processing part 206 acquires the status information of the scanner processing unit 115 and the scanner 117, and notifies the job control processing part 201 of the acquired status information.

A print processing part 207 is a module which executes the designated image process and the designated print process by controlling the image processing unit 112, the printer processing unit 116 and the printer engine 118 in response to instructions from the job control processing part 201. Further, the print processing part 207 accepts information such as the image data, image information (image data size, color mode, resolution, etc.), layout information (offset, enlargement/reduction, imposition, etc.), output paper information (size, print direction), and the like from the job control processing part 201.

Furthermore, the print processing part 207 executes an appropriate image process to the image data by controlling the image expansion unit 113, the image compression unit 114, the image processing unit 112 and the printer processing unit 116, and instructs to execute printing to a print paper by controlling the printer engine 118.

Furthermore, the print processing part 207 instructs to execute the printing to the print paper by controlling the printer processing unit 116 and the printer engine 118. The printer engine 118 controls the finisher 119 by sending an instruction from the CPU 101 to the finisher 119, on the basis of the information received from the printer processing unit 116. Then, the print processing part 207 acquires the status information of the printer processing unit 116, the printer engine 118 and the finisher 119, and notifies the job control processing part 201 of the acquired information.

Figure 3:
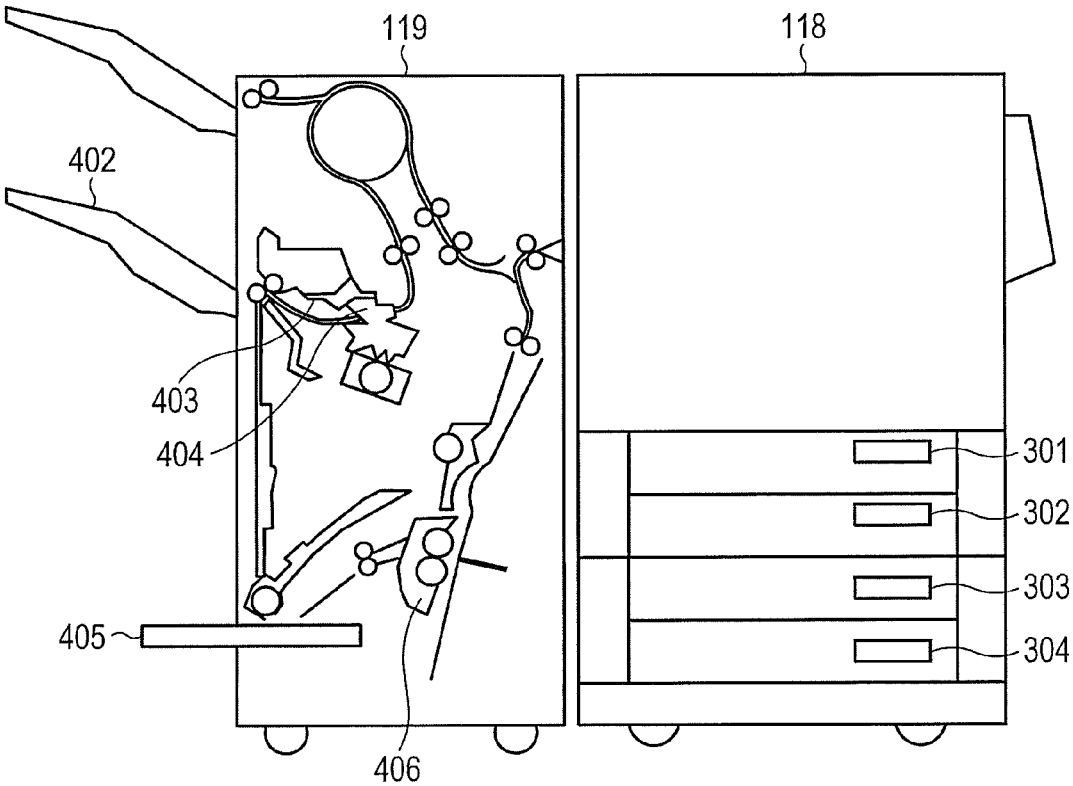
FIG. 3 is a cross section diagram illustrating an example of an image forming apparatus to which the sheet processing apparatus according to the embodiment of the present invention is applied.

FIG. 3 is a cross section diagram illustrating an example of the image forming apparatus to which a sheet processing apparatus according to the present embodiment is applied. More specifically, the image forming apparatus comprises, as sheet holding units for holding sheets respectively, four sheet feeding cassettes of a sheet feeding cassette 301, a sheet feeding cassette 302, a sheet feeding cassette 303 and a sheet feeding cassette 304. Incidentally, in the present embodiment, a case where the sheet feeding cassette is used as an insertion unit for inserting a specific sheet will be described. However, also in a constitution that an inserter for inserting a specific sheet is connected between the printer engine 118 and the finisher 119, it is possible to expect the same effect as above. Incidentally, in a case where specific sheets of different types, e.g., different-color sheets, different-thickness sheets or the like, are respectively held and stored in the different sheet feeding cassettes, it may be possible to pile together the specific sheets of the different types respectively fed from the different sheet feeding cassettes, and then execute a saddle stitch bookbinding process to the piled sheets.

In the present embodiment, a case where a position (i.e., an insertion page) in which the specific sheet is inserted is designated by a body-text page will be described.

More specifically, each of the plurality of sheet feeding cassettes detects the size of the sheet stored in the relevant sheet feeding cassette, and notifies the CPU 101 of the detected size through the printer engine 118, the printer processing unit 116 and the device I/F 111.

Moreover, device status information which includes status information of the finisher 119, the remaining quantity of the sheets stored in each of the sheet feeding cassettes, an open/close status of each of the sheet feeding cassettes, and the like is transferred to the CPU 101 through the printer processing unit 116 and the device I/F 111.

The finisher 119 illustrated in FIG. 3 comprises a stack tray 402, a process tray 403, a stapler 404, a booklet tray 405, and a saddle stitch bookbinding unit 406. The finisher 119 can execute a stapling process, a saddle stitch binding process, and a nonbinding folding process.

In the stapling process, the finisher 119 sequentially stores on the internal process tray 403 print sheets transported from the printer engine 118, and causes the stapler 404 to execute a binding (stapling) process to the stored print sheets on the process tray 403. Then, the finisher 119 discharges the prints acquired by the binding process to the stack tray 402.

In the saddle stitch bookbinding process, the finisher 119 causes the saddle stitch bookbinding unit 406 to bind the two points of the central portion of the print sheets, and then fold the sheets in half by putting the central portion of print the sheets in the roller by a pushing unit. Then, the print sheets which have been subjected to the bookbinding process by the saddle stitch bookbinding unit 406 are discharged to the booklet tray 405.

In the nonbinding folding process, the finisher 119 causes the saddle stitch bookbinding unit to fold the print sheets in half by putting the central portion of the print sheets in the roller by the pushing unit. Then, the folded sheets are discharged to the booklet tray 405.

Figure 4A:
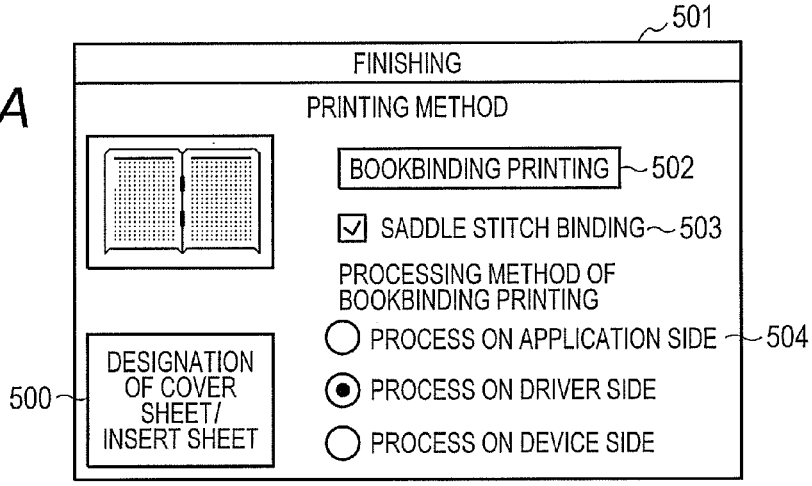
FIGS. 4A, 4B and 4C are diagrams respectively illustrating examples of user interfaces of an information processing apparatus.
Figure 4B:
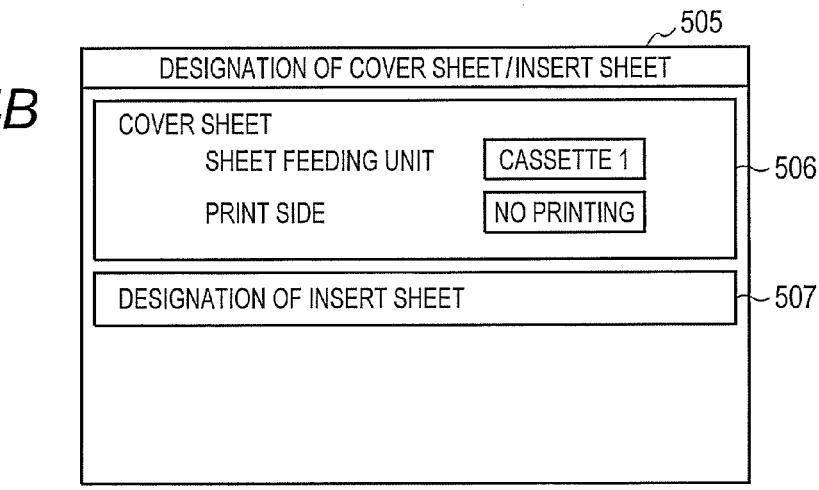
Figure 4C:
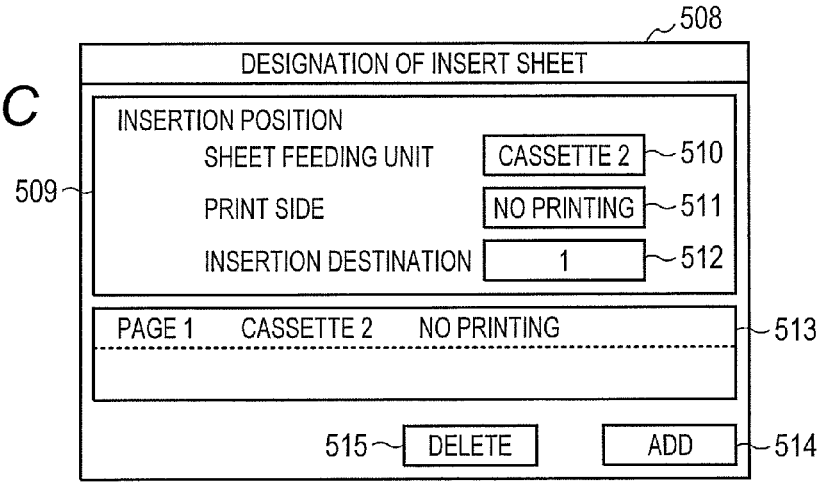

FIGS. 4A to 4C are diagrams respectively illustrating examples of operation screens (user interfaces) of the printer driver of an information processing apparatus (PC) which can communicate with the image forming apparatus according to the present embodiment.

More specifically, FIG. 4A illustrates a setting screen 501 for setting finishing. More specifically, in a printing method setting (section) 502, it is constituted that each one of "one-sided printing", "two-sided printing" and "bookbinding printing" can be set. Further, in a saddle stitch binding setting (box) 503, it is constituted to be able to select whether or not to execute saddle stitch binding when "bookbinding printing" has been selected and set. In a case where printing is started in the state that the saddle stitch binding setting 503 has been checked, the saddle stitch bookbinding process is executed. On the other hand, in a case where printing is started in the state that the saddle stitch binding setting 503 is not checked, the nonbinding folding process is executed.

Further, a processing method of bookbinding printing (section) 504 is constituted by a group of buttons to be used to determine whether an image layout process for print sheets should be executed on the image forming apparatus side or the information processing apparatus side. More specifically, the group of the buttons includes three kinds of buttons of a "process on application side" button, a "process on driver side" button and a "process on device side" button, so that a user can select any one of these buttons. Here, in a case where the "process on application side" button or the "process on driver side" button is selected, the image layout process is executed on the information processing apparatus side. On the other hand, in a case where the "process on device side" button is selected, the image layout process is executed on the image forming apparatus side. Incidentally, when a "designation of cover sheet/insert sheet" button 500 is depressed, the screen illustrated in FIG. 4B is displayed.

FIG. 4B illustrates a setting screen 505 for designation of a cover sheet and an insert sheet. In the setting screen 505, it is possible in a cover sheet setting (section) 506 to select the sheet feeding cassette from which the cover sheet is fed and also select whether or not to execute printing on the cover sheet. Besides, when a "designation of insert sheet" button 507 is depressed, the screen illustrated in FIG. 4C is displayed, so as to be able to execute setting of the insert sheet to be input into the body text.

On a setting screen 508 for designation of the insert sheet illustrated in FIG. 4C, a sheet feeding unit designation section 510, a print side designation section 511 and an insertion destination (insertion position) designation section 512 are displayed. Thus, the user determines the sheet feeding cassette from which the insert sheet is fed, by operating the sheet feeding unit designation section 510. Further, the user determines whether or not to print an image or the like on the insert sheet, by operating the print side designation section 511. Moreover, the user determines, in the body text, the insertion position in which the insert sheet should be inserted, by operating the insertion destination designation section 512. For example, when "1" is input in the insertion destination designation section 512, it is controlled to insert the insert sheet in the position next to the image of the first page in the body text. Moreover, when "2" is input in the insertion destination designation section 512, it is controlled to insert the insert sheet in the position next to the image of the second page in the body text. Here, it should be noted that an item which is set in an insertion position designation section 509 is actually added by depressing an addition button 514, and the added setting of the insert sheet can be confirmed in an insertion position confirmation column 513. Incidentally, the setting of the insert sheet that the user wishes to delete can be selected from the insertion position confirmation column 513. Then, the relevant insert sheet can be deleted actually by depressing a deletion button 515.

Figure 5:
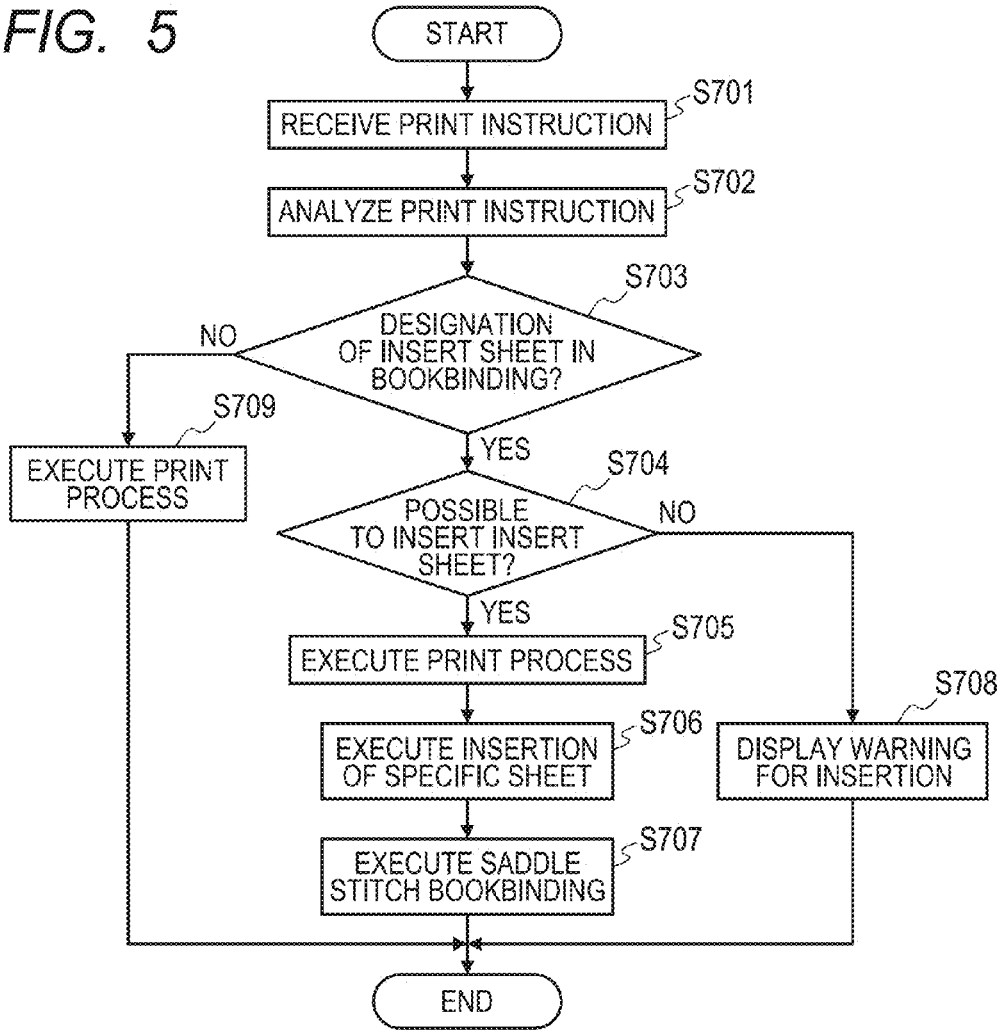
FIG. 5 is a flow chart for describing a control method of the sheet processing apparatus.

Subsequently, a print operation to be executed when the setting for the insert sheet has been made on the UI screens illustrated in FIGS. 4A to 4C will be described hereinafter with reference to a flow chart illustrated in FIG. 5. That is, FIG. 5 is the flow chart for describing a control method of the sheet processing apparatus according to the present embodiment. More specifically, this control method is corresponding to an example of a sheet process in which a post-process is executed using the insert sheet held and stored in the sheet feeding cassette illustrated in FIG. 3. Incidentally, it should be noted that each step of the process described in this flow chart is achieved on the condition that the CPU 101 controls the respective units by loading the respective modules illustrated in FIG. 2 to the RAM 102. Besides, it should be noted that, in the following description, the illustrated modules serve as the control entities respectively.

Initially, the job control processing part 201 receives a job (including a print instruction, a print setting, and image data) from the printer driver installed in the information processing apparatus (PC) 1000 which is connected to the controller unit through the LAN 120 (S701).

Subsequently, the job control processing part 201 analyzes the job received in S701, acquires the information of the analyzed job, and stores the acquired information in the HDD 104 (S702). After then, the job control processing part 201 executes the received job in accordance with the information of the job stored in the HDD 104.

More specifically, the job control processing part 201 judges, based on the information of the job acquired in S702, whether or not in the relevant job it has been set to execute the saddle stitch bookbinding process and it has been designated to insert the insert sheet (S703). Here, when it has been set at the saddle stitch binding setting 503 to execute the saddle stitch bookbinding process, it is assumed that the job control processing part judges that it has been set in the job to execute the saddle stitch bookbinding process. Besides, when it has been set at the setting screen 508 for designation of the insert sheet to insert the insert sheet, it is assumed that the job control processing part judges that it has been designated in the job to insert the insert sheet. Here, when the job control processing part 201 judges that in the relevant job it has been set to execute the saddle stitch bookbinding process and it has been designated to insert the insert sheet, then the process is advanced to S704. On the other hand, when the job control processing part 201 judges that in the relevant job it has not been set to execute the saddle stitch bookbinding process or it has not been designated to insert the insert sheet, then the process is advanced to S709.

In S709, the print process is executed in accordance with the setting of the job. For example, when it has been set in the job not to execute the saddle stitch bookbinding process but to execute the stapling process, the job control processing part 201 executes the stapling process to the sheets to which the print process has been executed. On another front, when it has been set in the job not to execute the post-process, the job control processing part 201 discharges the sheets to which the print process has been execute, without executing the post-process.

Figure 6A:
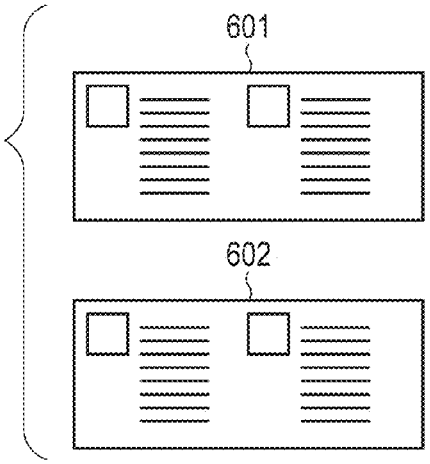
FIGS. 6A and 6B are diagrams for describing a sheet processing method of the sheet processing apparatus.
Figure 6B:
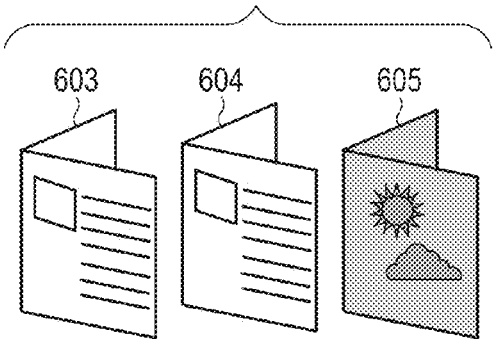

Subsequently, in S704, the job control processing part 201 judges whether or not it is possible to insert the insert sheet (that is, whether or not the insert sheet is insertable). More specifically, in this step, the job control processing part judges whether or not it is possible to insert the insert sheet in the insertion position. For example, in the present embodiment, image data of eight pages are input from the printer driver installed in the PC 1000. Then, the job control processing part 201 lays out the input image data of the eight pages respectively on the front two pages and the back two pages of sheets 601 and 602 illustrated in FIG. 6A. Further, the job control processing part 201 controls the saddle stitch bookbinding unit to execute the saddle stitch bookbinding process to the sheets on which the image data have been printed respectively. Furthermore, the job control processing part 201 controls the saddle stitch bookbinding unit to insert the insert sheet in the prints to which the saddle stitch bookbinding process should be executed. At that time, it is possible to insert the insert sheet after the image data printed on the fourth page, and it is thus possible to acquire the print result as illustrated in FIG. 6B. On the other hand, it is impossible to insert the insert sheet after the image data printed on the second page and after the image data printed on the third page. In other words, only in a case where it has been set to insert the insert sheet after the page of which the page number is indicated by "(total number of pages)/2", the job control processing part 201 judges that it is possible to insert the insert sheet in the prints. With that, when it is instructed to insert the insert sheet in the position where the insert sheet makes the facing pages, it is possible to actually execute the process of inserting the insert sheet. In other words, when it is instructed to insert the insert sheet in the positions other than the position where the insert sheet makes the facing pages, it is possible to inhibit the insertion process of the insert sheet.

Incidentally, it has been set to feed the normal sheets 601 and 602 from the sheet feeding cassette 301 illustrated in FIG. 3, and to feed the insert sheet (e.g., a sheet or a color sheet on which an image has already been printed) from the sheet feeding cassette 302.

Incidentally, it should be noted that the present invention is also applicable in a case where a sheet feeding cassette other than the sheet feeding cassette 302 is designated as the sheet feeding cassette from which the insert sheet is fed.

When the job control processing part 201 judges in S704 that it is possible to insert the insert sheet, the process is advanced to S705. In this step, the job control processing part 201 causes the printer engine 118 to feed the sheet from the sheet feeding cassette 301 and print the image of the page in the job on the fed sheet. Further, the job control processing part 201 causes the saddle stitch bookbinding unit 406 of the finisher 119 to accumulate the sheets on which the images have been printed respectively (S705). After then, in S706, the job control processing part 201 causes to feed the insert sheet from the sheet feeding cassette 302, and causes the saddle stitch bookbinding unit 406 of the finisher 119 to store the fed insert sheet (S706). Here, when it has been set on the print side designation section 511 illustrated in FIG. 4C to execute the printing on the insert sheet, the job control processing part 201 causes the printer engine to print the image on the relevant insert sheet. On the other hand, when it has been set on the print side designation section 511 illustrated in FIG. 4C not to execute the printing on the insert sheet, the job control processing part 201 causes the printer engine not to print an image on the relevant insert sheet.

After the sheets on which the images of the pages in the job had been printed respectively and the insert sheet were accumulated and stored, the job control processing part 201 stacks up the sheets and the insert sheet and then executes the saddle stitch bookbinding process to the stacked sheets (S707).

On the other hand, when the job control processing part 201 judges in S704 that it is impossible to insert an insert sheet 605 corresponding to a specific sheet, the process is advanced to S708. In S708, the job control processing part 201 displays, on the display of the operation unit 150, a warning message which indicates that it is impossible to insert the insert sheet, and then the process is completed. Incidentally, after the process in S708, the job control processing part 201 may control the saddle stitch bookbinding unit to execute, without inserting the insert sheet, the saddle stitch bookbinding process to the sheets on which the images of the pages in the job have been printed respectively, and then discharge the processed sheets.

Incidentally, the job in which the print instruction is accepted using the printer driver has been exemplarily described in the present embodiment. However, the present invention is not limited to this. For example, the present invention is also applicable to a copy job in which an image of an original document read by the scanner 117 is printed on a sheet by the printer engine 118, or to a box job in which a text stored in the HDD 104 of the image forming apparatus is printed in response to an instruction sent from the operation unit 150. In case of executing the copy job or the box job, the job control processing part 201 may display the screens respectively illustrated in FIGS. 4A to 4C on the display of the operation unit 150, and thus accept the instruction input by a user through the operation unit 150. According to the first embodiment, in the saddle stitch bookbinding process, it is possible to insert not only the cover sheet but also the insert sheet, whereby it is impossible to achieve a great diversity of bookbinding processes.

Incidentally, in the present embodiment, the example in which the job control processing part 201 judges in S704 that it is possible to insert the insert sheet only in the case where it has been set to insert the insert sheet after the page of which the page number is indicated by "(total number of pages)/2" has been described. However, the present invention is not limited to this. More specifically, the job control processing part 201 may judge that it is possible to insert the insert sheet, only in a case where it has been set to insert the insert sheet after the page of which the page number is multiples of "2". For example, in a case where it has been set to insert the insert sheet after the image data printed on the second page, the job control processing part 201 controls the saddle stitch bookbinding unit to insert the insert sheet between a sheet 603 and a sheet 604. In other words, the job control processing part 201 controls the saddle stitch bookbinding unit to insert the insert sheet in the position by which the insert sheet makes the third page of the prints.

Second Embodiment

In the first embodiment, the example in which the plain paper is used as the type of insert sheet has been described. In the present embodiment, an operation which is executed in a case where a sheet such as a thick paper or the like which is less foldable has been set in the sheet feeding cassette from which the insert sheet should be fed will be described.

Incidentally, since the hardware constitution and the software module configuration of the image forming apparatus to which the sheet processing apparatus according to the present embodiment is applied are the same as those already described in the first embodiment, the descriptions thereof will be omitted here. Moreover, in the present embodiment, as well as the first embodiment illustrated in FIGS. 4A to 4C, the example in which the print setting has been made by the settings of the printer driver of the PC 1000 will be descried.

Figure 7:
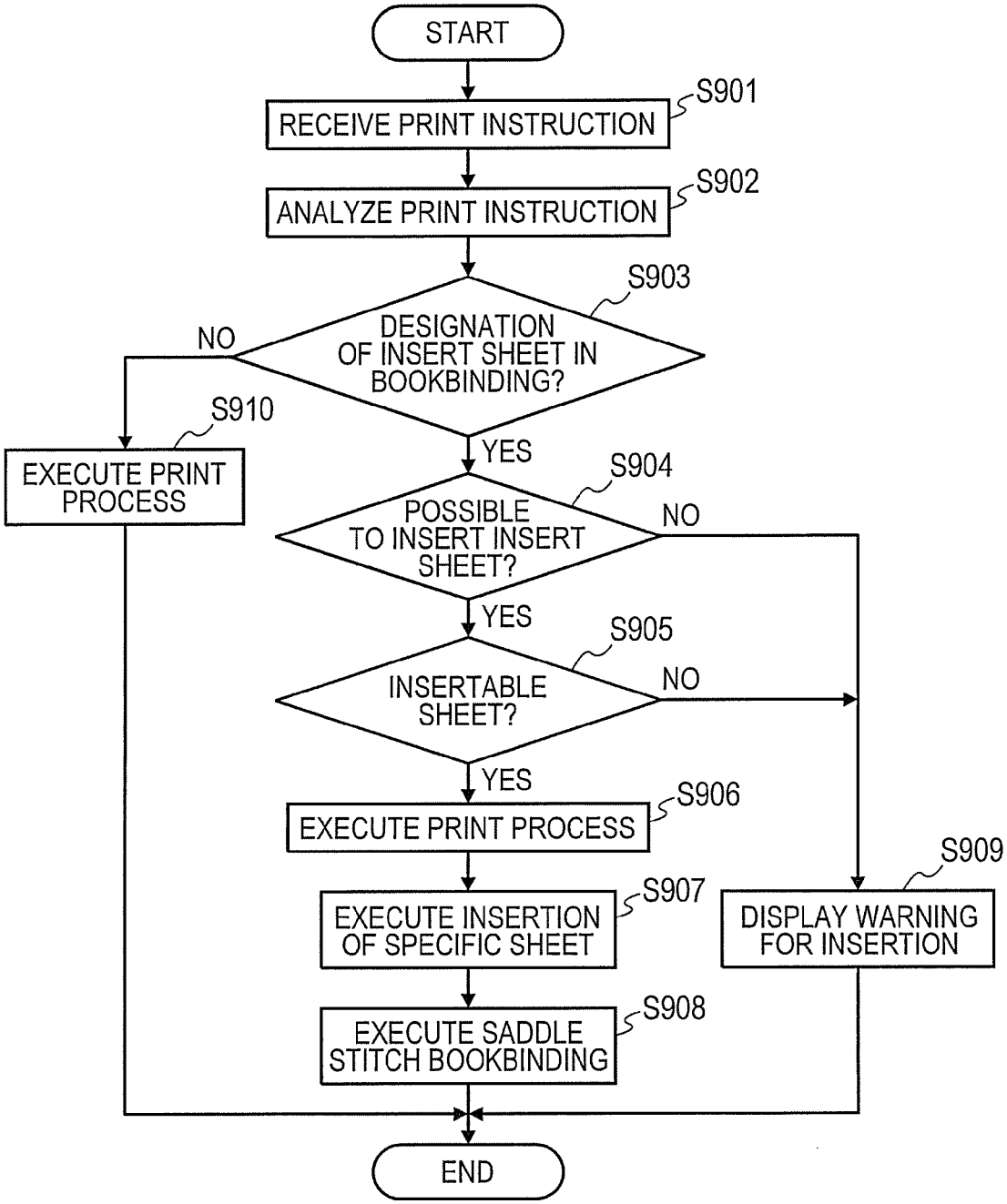
FIG. 7 is a flow chart for describing a control method of the sheet processing apparatus.

FIG. 7 is a flow chart for describing a control method of controlling the sheet processing apparatus according to the present embodiment. More specifically, this control method is corresponding to an example of a sheet process in which a sheet post-process is executed using the insert sheet held and stored in the sheet feeding cassette illustrated in FIG. 3, and is also corresponding to an example of a process which is executed when the sheet of a type to which it is impossible to execute a saddle stitch binding is set as the sheet feeding source of the insert sheet on the UI screens illustrated in FIGS. 4A to 4C. Incidentally, it should be noted that each step of the process described in this flow chart is achieved on the condition that the CPU 101 controls the respective units by loading the respective modules illustrated in FIG. 2 to the RAM 102. Besides, it should be noted that, in the following description, the illustrated modules serve as the control entities respectively.

Initially, the job control processing part 201 receives a job (including a print instruction, a print setting, and image data) from the printer driver installed in the information processing apparatus (PC) 1000 which is connected to the controller unit through the LAN 120 (S901).

Subsequently, the job control processing part 201 analyzes the job received in S901, acquires the information of the analyzed job, and stores the acquired information in the HDD 104 (S902). After then, the job control processing part 201 executes the received job in accordance with the information of the job stored in the HDD 104.

More specifically, the job control processing part 201 judges, based on the information of the job acquired in S902, whether or not in the relevant job it has been set to execute the saddle stitch bookbinding process and it has been designated to insert the insert sheet (S903). Here, when the job control processing part 201 judges that in the relevant job it has been set to execute the saddle stitch bookbinding process and it has been designated to insert the insert sheet, then the process is advanced to S904. On the other hand, when the job control processing part 201 judges that in the relevant job it has not been set to execute the saddle stitch bookbinding process or it has not been designated to insert the insert sheet, then the process is advanced to S910.

In S910, the print process is executed in accordance with the setting of the job. For example, when it has been set in the job not to execute the saddle stitch bookbinding process but to execute the stapling process, the job control processing part 201 executes the stapling process to the sheets to which the print process has been executed. On another front, when it has been set in the job not to execute the post-process, the job control processing part 201 discharges the sheets to which the print process has been execute, without executing the post-process. Meanwhile, when the process is advanced to S904, the job control processing part 201 judges whether or not it is possible to insert the insert sheet. Here, since the judgment in this step is the same as that already described in S704 of FIG. 5, the detailed description thereof will be omitted. Then, when the job control processing part 201 judges in S904 that it is possible to insert the insert sheet, the process is advanced to S905. On the other hand, when the job control processing part judges that it is impossible to insert the insert sheet, the process is advanced to S909.

Subsequently, in S905, the job control processing part 201 judges whether or not the type of inset sheet which has been set to be inserted is the type of sheet which is insertable. More specifically, the job control processing part 201 judges the type of insert sheet in S905 by using the table which is illustrated in FIG. 8 and has been stored in the HDD 104. That is, the table illustrated in FIG. 8 indicates types of insert sheets, indicates whether or not the sheet of each of the indicated types can be used as a cover sheet, and indicates whether or not the sheet of each of the indicated types can be used as a body text. Concretely speaking, the table indicates that each of a plain paper and a recycled paper can be folded or bended as the cover sheet or the body text, and that each of a thick paper and a coated paper cannot be folded or bended as the cover sheet or the body text.

When the job control processing part 201 judges, according to the table illustrated in FIG. 8, that the type of inset sheet which has been set to be inserted is the type of sheet which is insertable, the process is advanced to S906. On the other hand, when the job control processing part 201 judges that the type of inset sheet which has been set to be inserted is not the type of sheet which is insertable, the process is advanced to S909. Then, the job control processing part 201 causes the printer engine 118 to feed the sheet from the sheet feeding cassette 301 and print the image of the page in the job on the fed sheet. Further, the job control processing part 201 causes the saddle stitch bookbinding unit 406 of the finisher 119 to accumulate the sheets on which the images have been printed respectively (S906). After then, in S907, the job control processing part 201 causes to feed the insert sheet from the sheet feeding cassette 302, and causes the saddle stitch bookbinding unit 406 of the finisher 119 to store the fed insert sheet (S907). Here, when it has been set on the print side designation section 511 illustrated in FIG. 4C to execute the printing on the insert sheet, the job control processing part 201 causes the printer engine to print the image on the relevant insert sheet. On the other hand, when it has been set on the print side designation section 511 illustrated in FIG. 4C not to execute the printing on the insert sheet, the job control processing part 201 causes the printer engine not to print an image on the relevant insert sheet. After the sheets on which the images of the pages in the job had been printed respectively and the insert sheet were accumulated and stored, the job control processing part 201 stacks up the sheets and the insert sheet and then executes the saddle stitch bookbinding process to the stacked sheets (S908).

On the other hand, in a case where the process is advanced from S904 or S905 to S909, for example, when the job control processing part 201 judges that it is impossible to insert the insert sheet 605 corresponding to a specific sheet, the process is advanced to S909. In S909, the job control processing part 201 displays, on the display of the operation unit 150, a warning message which indicates that it is impossible to insert the insert sheet, and then the process is completed. Incidentally, after the process in S909, the job control processing part 201 may control the saddle stitch bookbinding unit to execute, without inserting the insert sheet, the saddle stitch bookbinding process to the sheets on which the images of the pages in the job have been printed respectively, and then discharge the processed sheets.

According to the second embodiment, in the case where the saddle stitch bookbinding process is executed to the insert sheet, when the type of insert sheet to be inserted is the type which is less foldable or cannot be folded, it is possible to notify the user of such a fact. Consequently, it is possible to prevent that quality of the prints deteriorates or the finisher 119 easily breaks sown because the insert sheet of the type which cannot be folded is forcedly folded.

Other Embodiments

In each of the above embodiments, the example of the process to be executed when a piece of insert sheet is inserted in the bound prints has been described. However, the present invention is not limited to this. For example, a user can set on the screen illustrated in FIG. 4C to insert a plurality of insert sheets in a copy of bound prints, by using the addition button 514. In this case, when the number of insert sheets to be inserted is equal to or larger than a predetermined number (n) of copies, the job control processing part 201 may notify the user of a fact that the insert sheets of which the number is equal to or larger than the predetermined number (n) of copies cannot be inserted, by displaying an error message indicating this fact on the display of the operation unit 150. Moreover, when the sum of the number of cover sheet and the number of insert sheets is equal to or larger than a predetermined number (m) of copies, the job control processing part 201 may display a similar error message on the display of the operation unit 150. By such controlling as above, it is possible to prevent that the number of insert sheets set to be inserted becomes large excessively and thus an amount of sheets of one copy exceeds the number of sheets which can be folded by the finisher 119.

The embodiments of the present invention can also be realized by a computer of a system or apparatus that reads out and executes computer executable instructions recorded on a storage medium (e.g., non-transitory computer-readable storage medium) to execute the functions of one or more of the above-described embodiments of the present invention, and by a method executed by the computer of the system or apparatus by, for example, reading out and executing the computer executable instructions from the storage medium to execute the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blue-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-143740, filed Jun. 27, 2012, which is hereby incorporated by reference herein in its entirety.

What is claimed is:

1. A sheet processing apparatus comprising:

an executing unit configured to insert an insert sheet fed from a second sheet holding unit in a plurality of sheets fed from a first sheet holding unit, and cause a saddle stitch bookbinding device to execute a saddle stitch bookbinding process to the plurality of sheets in which the insert sheet has been inserted;

a judging unit configured to judge whether or not a position in which it has been designated to insert the insert sheet is a position in which the insert sheet can be inserted; and a control unit configured to, in a case where it is judged that the position in which it has been designated to insert the insert sheet is not the position in which the insert sheet can be inserted, control the saddle stitch bookbinding device not to execute the saddle stitch bookbinding process to the plurality of sheets in which the insert sheet has been inserted.

2. The sheet processing apparatus according to claim 1, further comprising a determining unit configured to determine whether or not the insert sheet is a sheet of a type to which the saddle stitch bookbinding process can be executed, wherein, in a case where it is judged that the position in which it has been designated to insert the insert sheet is the position in which the insert sheet can be inserted and it is determined by the determining unit that the insert sheet is the sheet of the type to which the saddle stitch bookbinding process can be executed, the control unit controls the saddle stitch bookbinding device to execute the saddle stitch bookbinding process to the plurality of sheets in which the insert sheet has been inserted.

3. The sheet processing apparatus according to claim 2, further comprising a notification unit configured to, in the case where it is determined by the determining unit that the insert sheet is not the sheet of the type to which the saddle stitch bookbinding process can be executed, notify a user of this fact.

4. The sheet processing apparatus according to claim 2, wherein, in a case where the insert sheet is plain paper, the determining unit determines that the insert sheet is the sheet of the type to which the saddle stitch bookbinding process can be executed.

5. A control method for controlling a sheet processing apparatus, the method comprising:

inserting an insert sheet fed from a second sheet holding unit in a plurality of sheets fed from a first sheet holding unit, and causing a saddle stitch bookbinding device to execute a saddle stitch bookbinding process to the plurality of sheets in which the insert sheet has been inserted;

judging whether or not a position in which it has been designated to insert the insert sheet is a position in which the insert sheet can be inserted; and in a case where it is judged that the position in which it has been designated to insert the insert sheet is not the position in which the insert sheet can be inserted, controlling the saddle stitch bookbinding device not to execute the saddle stitch bookbinding process to the plurality of sheets in which the insert sheet has been inserted.

6. A non-transitory computer readable storage medium for storing a computer program for controlling a sheet processing apparatus, the computer program comprising:

code to insert an insert sheet fed from a second sheet holding unit in a plurality of sheets fed from a first sheet holding unit, and cause a saddle stitch bookbinding device to execute a saddle stitch bookbinding process to the plurality of sheets in which the insert sheet has been inserted;

code to judge whether or not a position in which it has been designated to insert the insert sheet is a position in which the insert sheet can be inserted; and code to, in a case where it is judged that the position in which it has been designated to insert the insert sheet is not the position in which the insert sheet can be inserted, control the saddle stitch bookbinding device not to execute the saddle stitch bookbinding process to the plurality of sheets in which the insert sheet has been inserted.

* * * * *